US006237700B1

(12) United States Patent
Berger et al.

(10) Patent No.: US 6,237,700 B1
(45) Date of Patent: May 29, 2001

(54) PNEUMATIC IMPACT MECHANISM WITH A DRIVE PISTON HAVING A REDUCED WALL THICKNESS

(75) Inventors: Rudolf Berger, Grünwald; Wolfgang Schmid, Munich, both of (DE)

(73) Assignee: Wacker-Werke GmbH & Co. KG (DE)

( * ) Notice: Subject to any disclaimer, the term of this patent is extended or adjusted under 35 U.S.C. 154(b) by 0 days.

(21) Appl. No.: 09/622,546

(22) PCT Filed: Jun. 24, 1999

(86) PCT No.: PCT/EP99/04415

§ 371 Date: Aug. 16, 2000

§ 102(e) Date: Aug. 16, 2000

(87) PCT Pub. No.: WO99/67064

PCT Pub. Date: Dec. 29, 1999

(30) Foreign Application Priority Data

Jun. 25, 1998 (DE) ..... 198 28 426

(51) Int. Cl.[7] ..... B25D 11/04

(52) U.S. Cl. ..... 173/201; 173/212; 173/109

(58) Field of Search ..... 173/201, 118, 173/200, 122, 121, 210, 212, 14

(56) References Cited

U.S. PATENT DOCUMENTS

| | | | | |
|---|---|---|---|---|
| 3,688,848 | * | 9/1972 | Vick et al. | 173/118 |
| 4,442,906 | * | 4/1984 | Simpson | 173/122 |
| 5,111,890 | * | 5/1992 | Ranger et al. | 173/201 |
| 5,161,623 | * | 11/1992 | Erlach | 173/212 |
| 5,435,397 | * | 7/1995 | Demuth | 173/201 |
| 5,775,440 | * | 7/1998 | Shinma | 173/201 |

FOREIGN PATENT DOCUMENTS

| | | |
|---|---|---|
| 3316013 A1 | 8/1984 | (DE) . |
| 2 160 810 | 1/1986 | (GB) . |

* cited by examiner

*Primary Examiner*—Scott A. Smith
(74) *Attorney, Agent, or Firm*—Boyle Fredrickson Newholm Stein & Gratz S.C.

(57) ABSTRACT

The invention relates to a pneumatic impact mechanism for a paving breaker and/or hammer drill which is characterized by a drive piston (1) having air equalization slits (5) and an extremely reduced wall thickness of the guide sleeve **(1*a*)** thereof This leads to a distinct reduction of the vibrations during the no-load operation of the impact mechanism, whereby advantageous characteristics of the impact mechanism with regard to wear behavior and compactness can be retained.

5 Claims, 3 Drawing Sheets

PNEUMATIC IMPACT MECHANISM WITH A DRIVE PISTON HAVING A REDUCED WALL THICKNESS

BACKGROUND OF THE INVENTION

1. Field of the Invention

The invention relates to a pneumatic-spring percussion mechanism for an impact hammer and/or drill hammer.

2. Description of the Related Art

Among the currently conventional types of percussion mechanism for drill hammers or impact hammers, the design which has proven successful, in particular, is one in which a drive piston designed as a hollow piston is made to move axially in an oscillating manner via a crank mechanism. A solid percussion piston is moved in the interior of the drive piston, which is guided in the housing of the hammer, said percussion piston projecting at the open end of the hollow drive piston and acting cyclically on a cutter tool or an interposed riveting set. A pneumatic spring is formed for this purpose in a cavity between the percussion piston and the drive piston, said pneumatic spring transmitting the forced movement of the drive piston to the percussion piston and driving the latter against the tool.

The percussion mechanism takes up a comparatively small amount of space and can be produced cost-effectively. Furthermore, the percussion system reaches a high impact speed. The reliable start-up of the percussion mechanism from idling is also particularly advantageous.

The disadvantage, however, is the high mass of the drive piston, since the latter is moved back and forth by the drive even during idling, i.e. in a state in which the tool is not working on any materials. The comparatively large oscillating masses render the hammer more difficult to handle during idling.

U.S. Pat. No. 3,456,740 discloses a percussion mechanism with a double-acting pneumatic spring. Provided in a drive piston is an air-equalizing slot over which a percussion piston which can be moved back and forth in the interior of the drive piston can pass such that alternately the front and the rear pneumatic springs are brought into connection with the surroundings. As a result, the pneumatic springs are recharged after each blow. However, such double pneumatic-spring percussion mechanisms require a large amount of space and cannot be operated in idling mode.

EP 0 014 760 A1 describes a pneumatic-spring mechanism with a hollow drive piston in which a percussion piston is driven by a pneumatic spring which forms between the drive piston and the percussion piston. When the hammer in which the percussion is used is raised from the rock which is to be worked, the percussion piston is displaced forward to such an extent that the pneumatic spring can be brought into connection with the surroundings via an idling bore. The refilling of the pneumatic spring in percussion operation takes place via a radial bore in a guide sleeve of the drive piston, which is activated via a stationary slot.

The object of the invention, while maintaining the positive features of the percussion mechanism, is to achieve a reduction in the vibrations occurring during idling.

The object is achieved according to the invention by a pneumatic-spring percussion mechanism according to claim 1. Advantageous configurations of the pneumatic-spring percussion mechanism are defined in the subclaims.

The pneumatic-spring percussion mechanism according to the invention has a drive piston which has a piston-suspension means, a piston head and a guide sleeve, at least one air-equalizing slot being provided in the guide sleeve. It is possible for the guide sleeve to be of hollow-cylindrical design or to be elliptical or to have a number of sides.

A preferred embodiment is defined in that the air-equalizing slot extends in the axial direction of the guide sleeve. It is particularly advantageous, therefore, for the guide sleeve to have the smallest possible wall thickness, of less than 5% of the diameter of the guide sleeve, and to be provided with idling openings.

OBJECTS AND SUMMARY OF THE INVENTION

The drive piston my particularly advantageously be used in the pneumatic-spring percussion mechanism in that a percussion piston can be moved axially back and forth in the guide sleeve of the drive piston. In this case, the air-equalizing slot of the drive piston is of a greater axial length than a contact surface between the percussion piston and the guide sleeve, with the result that a cavity which is formed between the drive piston and the percussion piston and encloses a pneumatic spring can be brought into action with a front part of the drive piston i.e. a front end of the hollow drive piston. If the drive piston is then guided in the manner in which it is largely completely enclosed by a guide tube belonging, for example, to the housing of the hammer, the pneumatic spring can have air admitted to it after each blow via the air-equalizing slot, in which air is taken into the cavity from the surroundings, i.e. from the end side of the drive piston. In this case, the air-equalizing slot is covered on its radially outer side by the guide tube, with the result that a connection between the cavity and the surroundings is possible only in certain relative positions between the percussion piston and the drive piston, that is to say whenever the percussion piston has the entire length of its contact surface with the drive piston located within the axial extent of the air-equalizing slot. This arrangement allows an extremely compact construction of the percussion mechanism since it is possible to dispense with any radial air-admission openings. Moreover, the drive piston may be designed with minimal wall thickness and thus with the lowest possible weight, which considerably reduces the occurrence of undesired vibrations, in particular during idling.

Insofar as a plurality of idling openings are advantageously arranged in zigzag form in two rows in the drive piston and the guide tube of the hammer housing has an associated air-admission channel, which is possible, moreover, to have a reliable changeover between idling and percussion operation. The point in time at which the percussion mechanism transfers to idling, on account of the tool and thus the percussion piston being displaced forward, can be set precisely by the position of the air-admission channel and of the idling openings.

BRIEF DESCRIPTION OF THE DRAWINGS

The invention is explained in more detail hereinbelow with the aid of the accompanying figures, in which.

DETAILED DESCRIPTION OF THE PREFERRED EMBODIMENTS

Figure 1:
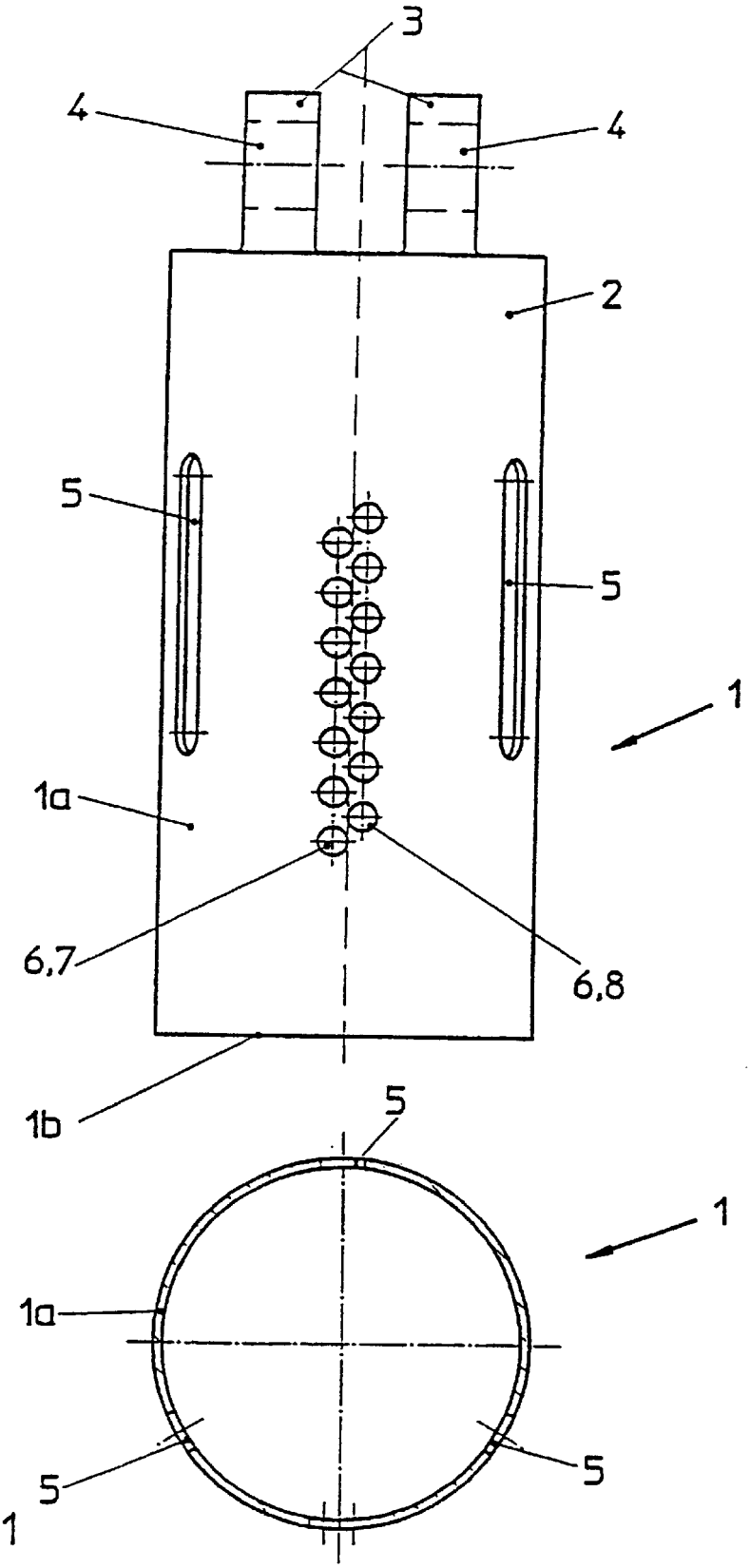
FIG. 1 shows a side view and a cross section of the drive piston according to the invention.

FIG. 1 shows a drive piston 1 according to the invention in side view and in cross section.

The drive piston 1 is produced from steel and has a hollow-cylindrical guide sleeve 1*a*. On one end side 1*b*—at the bottom end in FIG. 1—the guide sleeve 1*a* is open and, on the other end side, the guide sleeve is covered by a piston head 2. Extending from the piston head 2 is a piston-suspension means 3 in the form of two webs which each have bores 4 passing through them transversely to the axial direction of the drive piston 1. A connecting-rod pin is pushed into the bores 4—as is explained at a later stage in the text with reference to FIG. 2—said pin connecting the drive piston 1 in an articulated manner to a connecting rod.

Provided in the guide sleeve 1*a* are three air-equalizing slots 5 which are offset by 120 ° in relation to one another and extend in the axial direction of the guide sleeve 1*a*. The air-equalizing slots 5 serve for supplying with fresh air, after each percussion cycle, a pneumatic spring which forms in the interior of the guide sleeve 1*a*.

Also formed in the guide sleeve 1*a* are idling openings 6 which are arranged in zigzag form in two axial rows 7, 8. In this case, the distance between the individual idling openings 6 is dimensioned such that, during an axial movement, the idling openings 6 can pass over a theoretical edge positioned here tangentially to the guide sleeve 1*a*, such that, in the region of the edge, there is a permanent connection between the interior of the guide sleeve 1*a* and the exterior of the latter. For this purpose, in each case at least two idling openings 6 from different rows 7, 8 are adjacent to one another, these center points of the relative idling openings 6, in the axial direction of the guide sleeve 1*a*, being spaced apart by a distance which is smaller than the mean of the diameters of the relevant idling openings, as can be seen from FIG. 1.

The guide sleeve 1*a* has an extremely thin wall made of steel and has a thickness of less than 3 mm. The weight of the drive piston 1 can be minimized as a result. Maintaining the steel material ensures particularly good wearing, emergency-running and sealing properties.

The guide sleeve 1*a* according to FIG. 1 is of hollow-cylindrical design. In other embodiments, however, it may also be of other basic shapes and have, for example, an elliptical hollow cross section or one with a number of sides. The shape of the components which guide the guide sleeve (housing) or are guided by the guide sleeve (percussion piston) have to be adapted accordingly.

Figure 2:
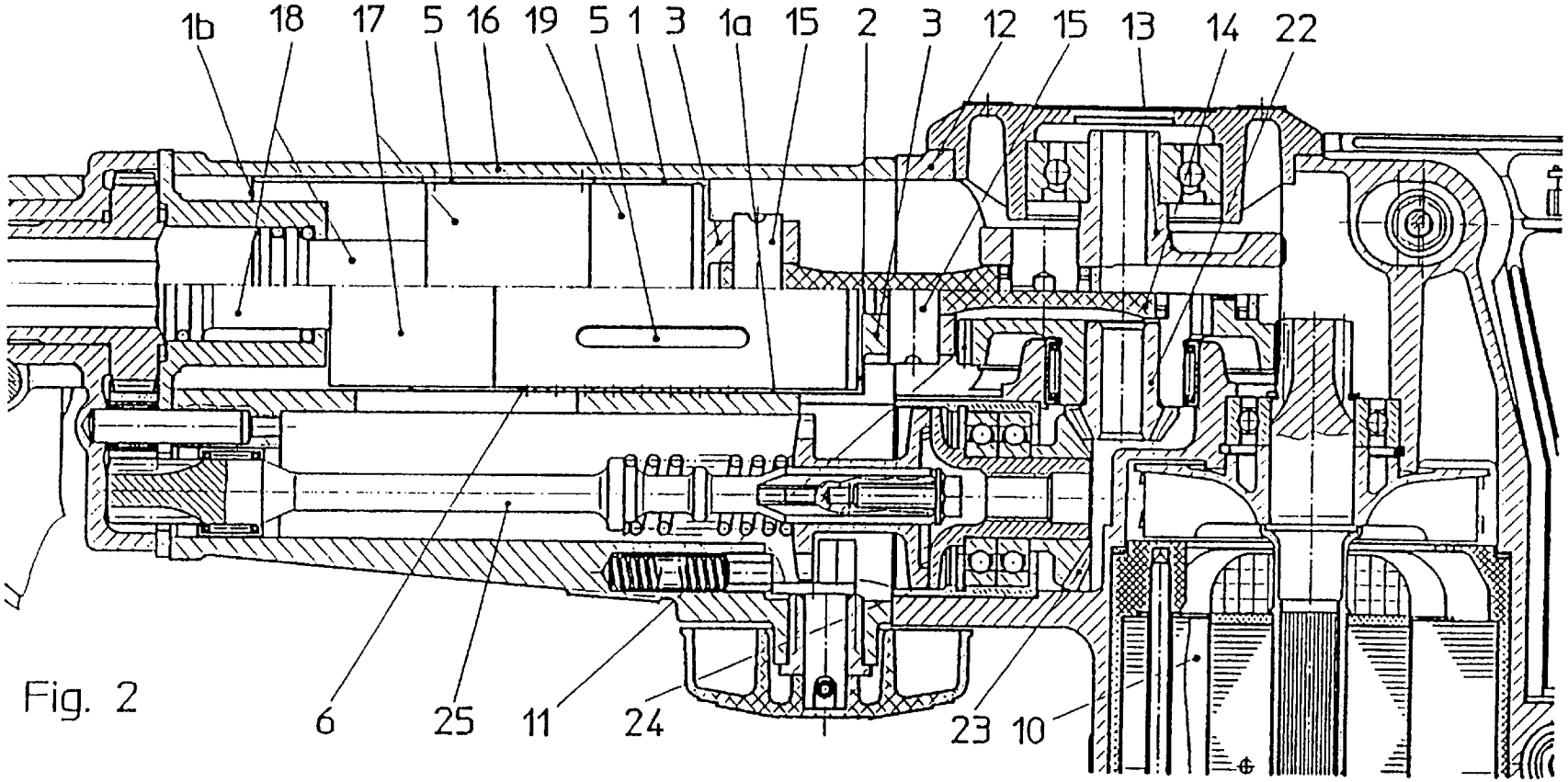
FIG. 2 shows a partial section through a drill hammer with a pneumatic-spring percussion mechanism, in which use is made of the drive piston according to the invention from FIG. 1.
Figure 3:
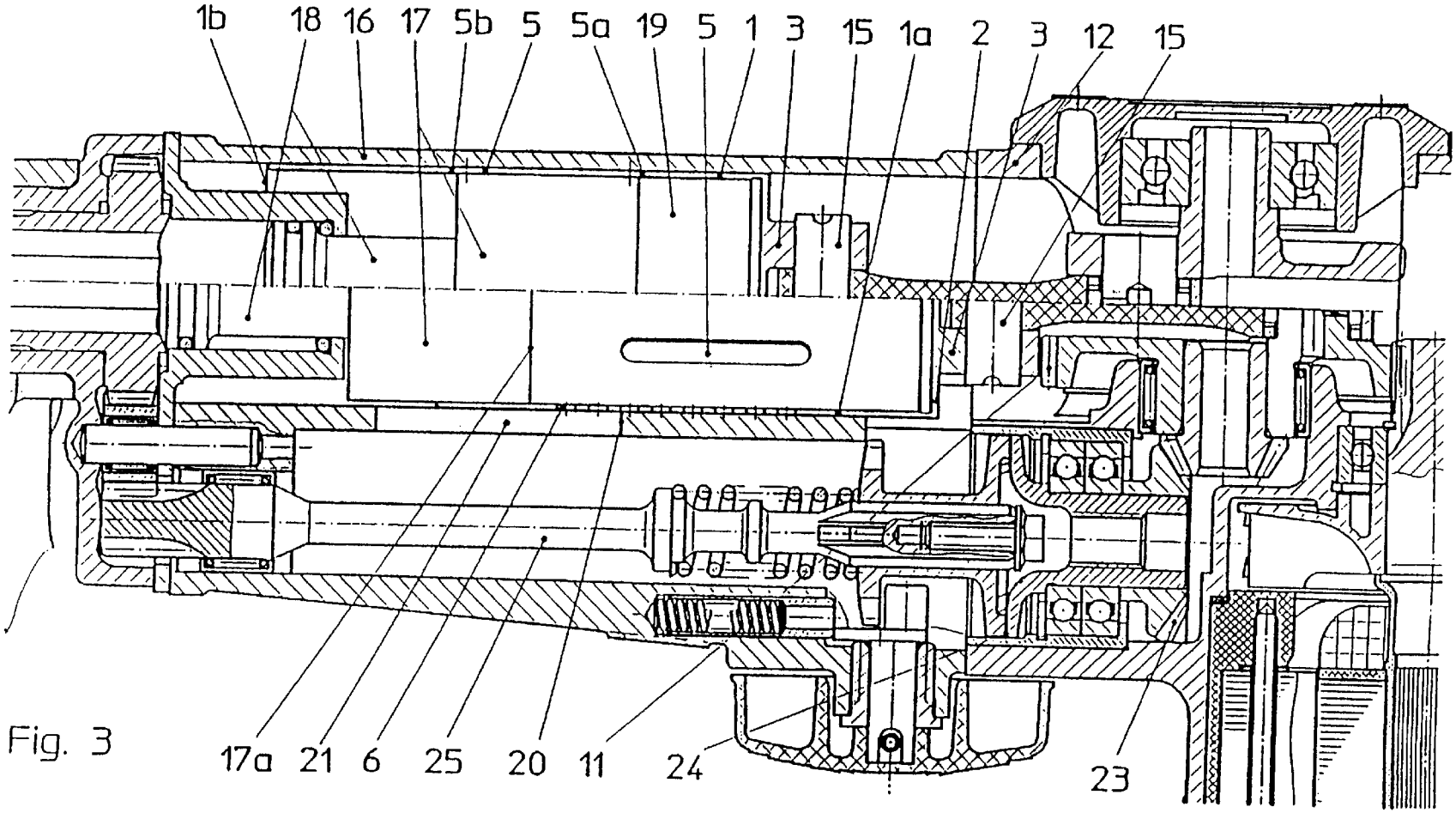
FIG. 3 shows an enlarged detail from FIG. 2.

FIG. 2 shows a partial section through a drill hammer, in which the drive piston 1 according to the invention is used in a pneumatic-spring percussion mechanism. FIG. 3 is an enlarged detail from FIG. 2 and serves for clarifying the illustration of the percussion mechanism.

Illustrated in the top third of FIGS. 2 and 3, i.e. above a continuous chain-dotted line, is an impact position which occurs during percussion operation. The idling, in which the tool (not illustrated) has been raised from the material which is to be worked, is illustrated beneath the chain-dotted line.

A crankshaft gear wheel 11 is driven in rotation via an electric motor 10 and, along with a crankshaft pulley 13 mounted rotatably in a hammer housing 12, forms a crankshaft which drives a connecting rod 14 made of plastic.

At its other end, the connecting rod 14 is connected in an articulated manner via a connecting-rod pin 15, to the piston-suspension means 3 of the drive piston 1 according to the invention and thus, during corresponding rotary movement of the crankshaft, moves the drive piston 1, with its piston head 2 and the guide sleeve 1*a*, axially back and forth in a guide tube 16 belonging to the hammer housing 12.

Arranged in an axially moveable manner in the interior of the guide sleeve 1*a* is a percussion piston 17 which, in a manner known per se, strikes a likewise axially moveable riveting set 18 cyclically against a tool (not illustrated). For this purpose, a pneumatic spring is formed in a cavity 19 between the drive piston 1 and the percussion piston 17 and transmits to the percussion piston 17 the movements to which the drive piston 1 is subjected by the crank mechanism. As the drive piston 1 moves rearward, the pneumatic spring assists, by suction action, the rearward movement of the percussion piston 17 brought about by the rebound of the percussion piston 17 from the tool and/or the riveting set 18.

The drive piston 1 is guided in the guide tube 16 with sliding action by way of its guide sleeve 1*a*, the inner contour of the guide tube 16 being adapted to the outer contour of the guide sleeve 1*a*. In the embodiment shown, the guide tube 16 is hollow-cylindrical, but, for example in the case of a guide sleeve 1*a* which has a number of sides, it may also have planar guide surfaces. As has already been described, the guide sleeve 1*a* is extremely thin-walled and has the air-equalizing slots 5, which, via the front end side 1*b* of the drive piston 1, can be brought into connection with the ambient-air atmosphere in the interior of the hammer housing 11.

The air-equalizing slots 5 are completely covered on their radially outer surface by the guide tube 16 and, with corresponding relative positions of the drive piston 1 and percussion piston 17, feed the air to the cavity 19 in the axial direction. The air-equalizing slots 5 are of a greater axial length than the percussion piston 17, but at least of a greater axial length than a contact surface between the percussion piston 17 and the guide sleeve 1*a* of the drive piston 1. As can be seen particularly clearly in the enlarged illustration of FIG. 3, this makes it possible for the air to be guided past the percussion piston 17 by way of the air-equalizing slots 5 when the percussion piston 17 has its entire length located within the axial length of the air-equalizing slots 5.

The percussion operation of the pneumatic-spring percussion mechanism according to the invention is explained hereinbelow with reference to the impact position, which is illustrated above the chain-dotted line in FIGS. 2 and 3.

The relevant illustration shows the moment at which the drive piston 1 has been moved, by the connecting rod 14 and the crank mechanism, into its extreme left-hand position corresponding to a front dead-center position. On account of the pneumatic spring which forms in the cavity 19, the percussion piston 17 is made to strike, in the forward direction, against the riveting set 18, which, in turn, transmits the impact energy to the tool (not illustrated).

As can be seen in the figures, at this moment in time, the cavity 19 is in connection, via the air-equalizing slots 5, with the ambient atmosphere, but at least with the front end side 1*b* of the drive piston 1, with the result that air can flow into the cavity 19 and can recharge the pneumatic spring.

This drive piston 1 is then moved to the right by the crank mechanism, as a result of which air continues to be taken in via the air-equalizing slot 5. The percussion piston 17 rebounds from the riveting set 18 and, with a certain time delay, follows the movement of the drive piston 1. Moreover, it is moved back by suction by the negative pressure produced in the cavity 19. When the percussion piston 17 or its contact surface with the guide sleeve 1*a* has passed over a rear control edge 5*a* of the air-equalizing slot 5, the cavity 19 is sealed again in relation to the surroundings, with the result that the pneumatic spring can be reformed during the next forward movement of the drive piston 1.

If the operator does not use the normally necessary force to press the hammer against the material which is to be worked, it is possible for the point at which the percussion piston 17 strikes against the riveting set 18 to slip some way forward. Rather than the idling position, which will be described at a later stage in the text, being reached here, the percussion piston 17 then passes a front control edge 5*b* of the air-equalizing slot 5 by way of its front edge or of a front edge of its contact surface with the sleeve 1*a*, as a result of which the connection between the cavity 19 and the surroundings is interrupted again, with the result that, after filling of the pneumatic spring in the cavity 19, no further air can penetrate into the cavity 19. This results in the filling quantity for the pneumatic spring in the cavity 19 remaining relatively constant, which results in a largely constant impact action during the following blow. In contrast, it is frequently possible, in the case of the equipment known from the prior art, for the pneumatic spring volume, in such a case, to be increased by the forward displacement of the percussion piston, which, in the following percussion cycle, results in a lesser impact action, but at least in an irregular blow.

The pneumatic-spring percussion mechanism is shown in the idling position beneath the chain-dotted line in FIGS. 2 and 3.

As has already been explained, zigzag-arrangement idling openings 6 are formed in the drive piston 1. The idling position is reached by the tool being raised from the material which is to be worked and by the tool thus being able to slip some way out of the hammer. The riveting set 18 follows the movement of the tool and is displaced into the extreme front or left-hand position illustrated in the figures. This likewise applies to the percussion piston 17, with the result that the percussion piston 17 passes by way of a percussion-piston rear edge 17*a*, located on its rear end surface, over a control edge 20 of an air-admission channel 21 which is formed in the guide tube 16 and extends in the axial direction. Virtually precisely at the point in time at which the percussion-piston rear edge 17*a* passes over the control edge 20, the air-emission openings 6 allow a connection between the cavity 19 and the surroundings, as a result of which air is admitted to the cavity 19 and it is no longer possible for pressure to build up effectively. The percussion mechanism moves into the idling position. It is only when the tool is repositioned and the riveting set 18 and the percussion piston 17 are thus moved back that the percussion-piston rear edge 17*a* can pass over the control edge 20 again, as a result of which the connection between the cavity 19 and air-emission channel 21 is interrupted. The percussion mechanism then resumes operation.

In addition to the percussive movement, the drill hammer illustrated can also subject the tool to a rotary movement. For this purpose, a bevel pinion 22 is shrunk on the crankshaft, said pinion meshing with a bevel wheel 23. The rotary movement of the bevel wheel 23 is transmitted, via a safety coupling 24 known per se, to a vertical shaft 25, from where it is forcibly transmitted to the tool in a manner which is known, but not illustrated.

The air-equalizing slots 5 provided according to the invention replace the hitherto conventional air-equalizing pockets on the inner wall of the guide sleeve 1*a*. This makes it possible to minimize the wall thickness of the guide sleeve 1*a* and thus to save a considerable amount of weight, which has no advantageous effect on the vibration behavior of the percussion mechanism during idling. Furthermore, less material is used during production, as a result of which the production costs can be reduced.

What is claimed is:

1. A pneumatic-spring percussion mechanism for an impact hammer and/or drill hammer, having a drive piston (1) which can be moved axially back and forth and has a guide sleeve (1*a*), a piston head (2) and a piston-suspension means (3);

a percussion piston (17) which can be moved axially back and forth in the guide sleeve (1*a*); and having a cavity (19) which is formed between the drive piston (1) and the percussion piston (17) and encloses a pneumatic spring; it being the case that provided in the guide sleeve (1*a*) is at least one air-equalizing slot (5) which is of a length which is greater than the axial length of a contact surface between the percussion piston (17) and the guide sleeve (1*a*);

the guide sleeve (1*a*) is guided by a guide tube (16) which covers the air-equalizing slot (5) on its radially outer side; and the cavity (19) can be brought into connection with a front end side (1*b*) of the drive piston (1) via the air-equalizing slot (5).

2. The pneumatic-spring percussion mechanism as claimed in claim 1, wherein the guide sleeve (1*1*) has a wall thickness of less than 5% of the diameter of the guide sleeve.

3. The pneumatic-spring percussion mechanism as claimed in claim 1, wherein at least one idling opening (6) is provided in the guide sleeve (1*a*).

4. The pneumatic-spring percussion mechanism as claimed in claim 3, wherein the idling openings (6) are arranged in two adjacent rows (7, 8) in the axial direction of the guide sleeve (1*a*), it being the case that in each case at least two idling openings (6) from different rows are adjacent to one another and the center point of the relevant idling openings (6), in the axial direction of the guide sleeve (1*1*), are spaced apart by a distance which is smaller than the mean of the diameters of the relevant idling openings.

5. The pneumatic-spring percussion mechanism as claimed in claim 3, wherein provided in the guide tube (16) is at least one air-admission channel (21), over which the idling openings (6) can pass during movement of the drive piston (1).

* * * * *